United States Patent [19]

Keagbine

[11] 4,258,949

[45] Mar. 31, 1981

[54] EXTENSIBLE SPREADER FRAME FOR CARGO CONTAINERS

[75] Inventor: Francis R. Keagbine, Portland, Oreg.

[73] Assignee: Allied Systems Company, Tigard, Oreg.

[21] Appl. No.: 55,708

[22] Filed: Jul. 9, 1979

[51] Int. Cl.[3] ..... B66C 1/66

[52] U.S. Cl. ..... 294/81 SF; 294/67 DA

[58] Field of Search ..... 294/67 R, 67 B, 67 BB, 294/67 BC, 67 D, 67 DA, 67 DB, 81 R, 81 SF, 83 R, 86 R, 111-113; 414/607, 608

[56] References Cited

U.S. PATENT DOCUMENTS

| | | | |
|---|---|---|---|
| 2,382,626 | 8/1945 | Gaston et al. | 294/67 R X |
| 2,425,421 | 8/1947 | Deily | 294/67 DB |
| 2,847,245 | 8/1958 | Leslie | 294/81 SF X |
| 3,076,673 | 2/1963 | Kaplan et al. | 294/81 R X |
| 3,161,309 | 12/1964 | Baudhuin et al. | 294/81 SF X |
| 3,498,665 | 3/1970 | Karttunen | 294/81 SF |
| 3,576,269 | 4/1971 | Shaffer | 294/67 R X |
| 3,712,661 | 1/1973 | Strand | 294/81 SF X |
| 3,734,324 | 5/1973 | Lynch et al. | 414/608 |

FOREIGN PATENT DOCUMENTS

| | | | |
|---|---|---|---|
| 2207821 | 8/1973 | Fed. Rep. of Germany | 294/81 SF |

*Primary Examiner*—Johnny D. Cherry

[57] ABSTRACT

An extensible lifting spreader frame for handling cargo containers comprises a pair of oppositely extending beam arms slidably received within a central pair of side-by-side connected sleeve beams. Beam cross arms at the outer ends of the sleeve beams mount twist-lock latching hooks at their opposite ends for attachment to the four socketed top corners of a cargo container for lifting the same. The frame is suspended from an overhead crane by four flexible suspension cables connected to the opposite ends of the cross arms. A pair of actuating cables operated from the crane operates mechanical cam-operated latch actuating mechanism. A pull cable, also operated from the crane, operates with pulleys on the sleeve beams to extend the beam arms from their retracted positions. Manually operable mechanism, also on the sleeve beams, inserts locking pins into aligned holes in the sleeve beams and beam arms to lock the arms in adjusted positions. The twist-lock hooks have associated safety locking devices, including touch pads, which prevent either of the latching hooks of a cross arm from moving between its latched and unlatched positions unless both hooks are properly positioned within corresponding sockets of the container top.

6 Claims, 14 Drawing Figures

FIG. 6
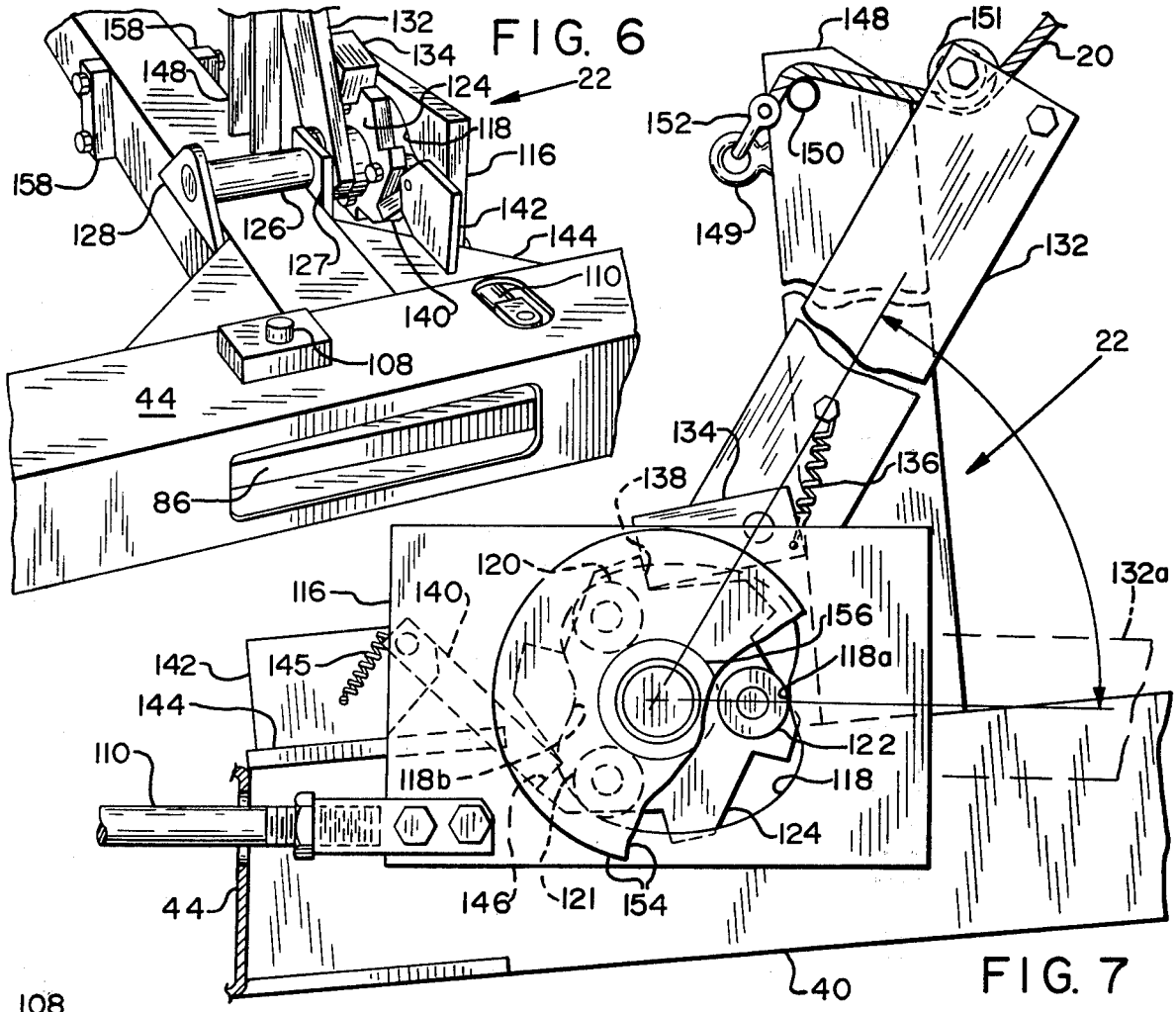
FIG. 7
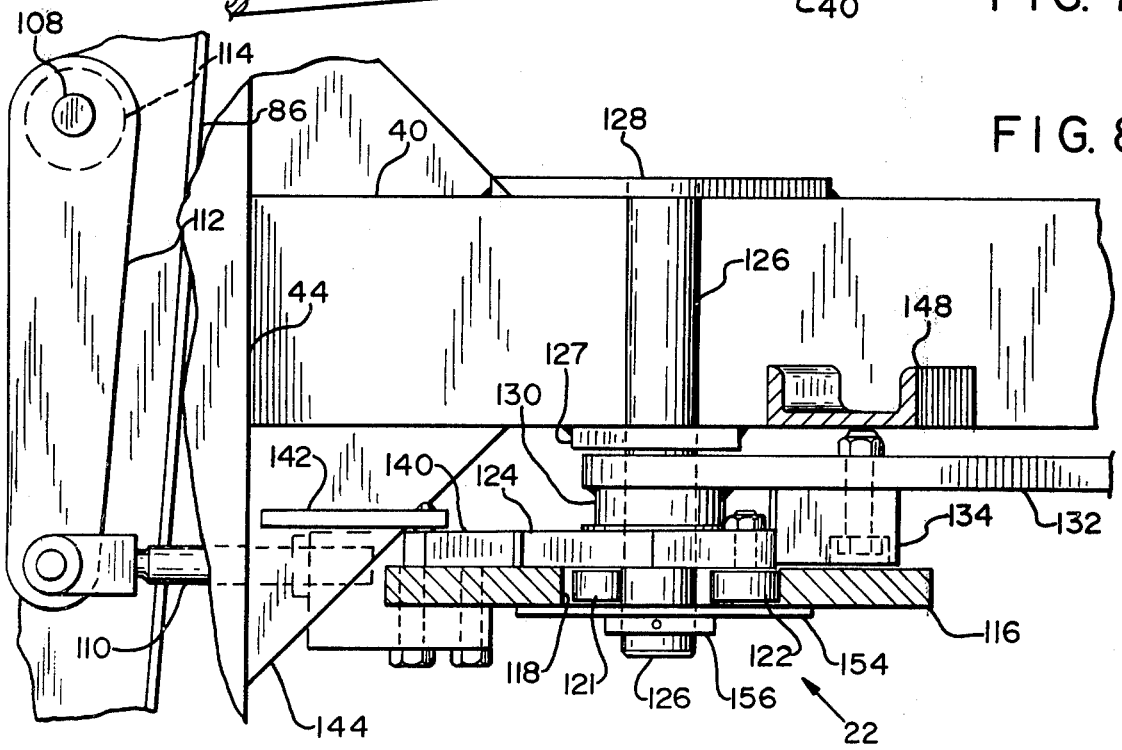
FIG. 8

FIG. 13
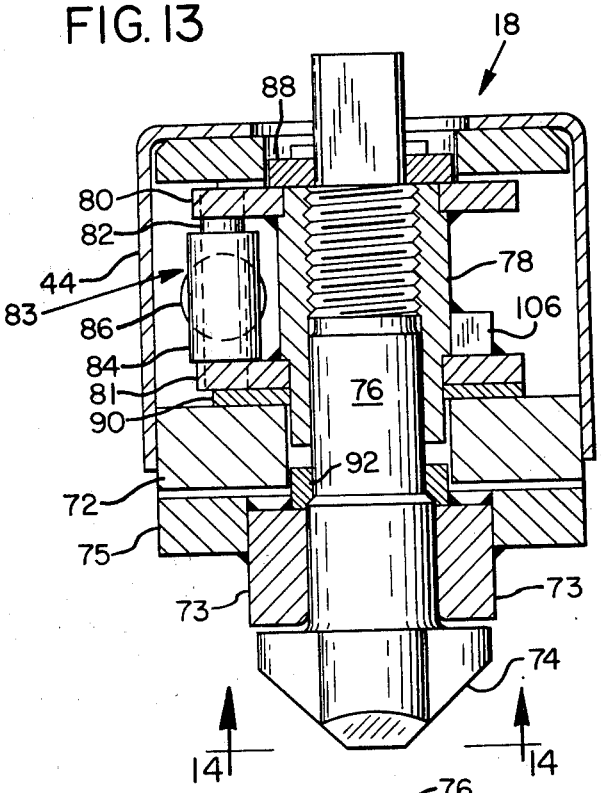
FIG. 12
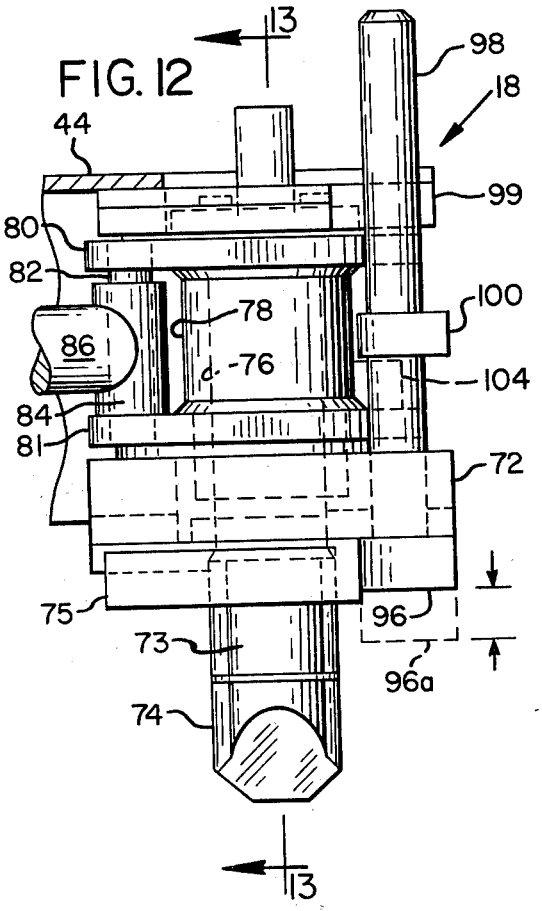
FIG. 14
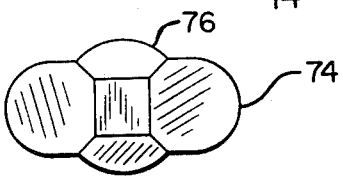
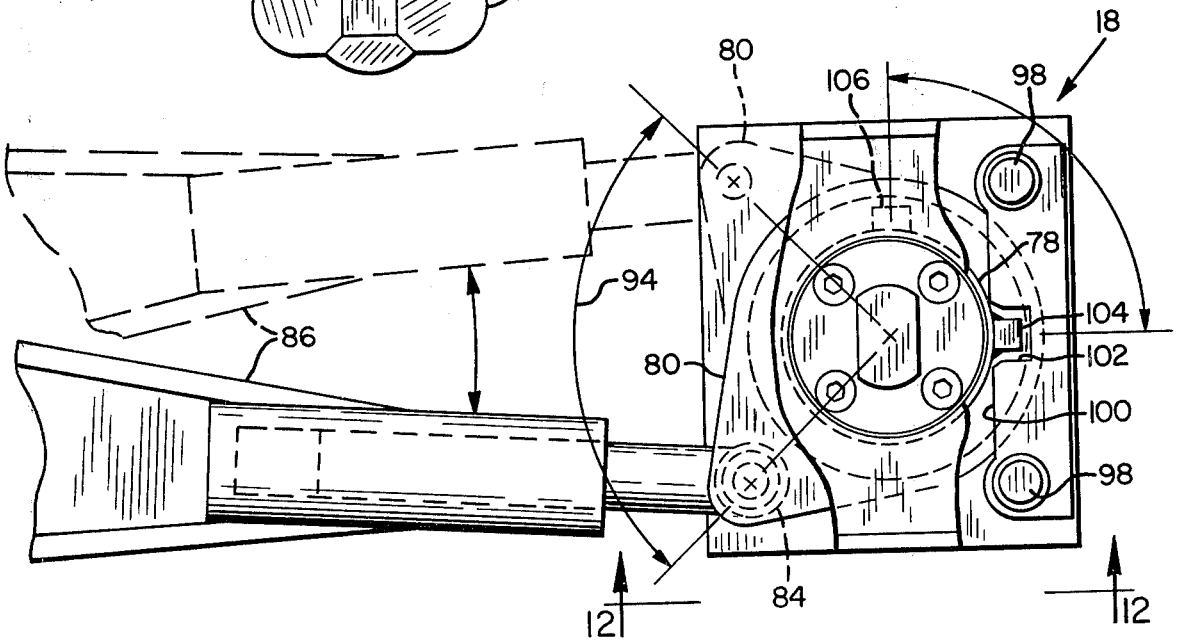
FIG. 11

EXTENSIBLE SPREADER FRAME FOR CARGO CONTAINERS

BACKGROUND OF THE INVENTION

1. Field of the Invention

The present invention relates generally to an extensible lifting spreader frame for handling cargo containers.

2. Description of the Prior Art

Container handling spreader frames for attachment to an overhead crane or to lift trucks for handling containerized loads are well known. Typically, such prior spreader frames lift and handle cargo containers either from the bottom, using grappling arms attached to the frame, as exemplified by Whiteman U.S. Pat. No. R. 27,905, or from the top using hook-type latching devices carried by the frame, which interengage sockets at the four top corners of a container, as exemplified by Durenec U.S. Pat. No. 3,888,536.

Containers which are handled by spreader frames typically are of constant width and of one of two standard lengths, twenty- and forty-foot. Therefore, it is also common to provide extensible spreader frames which can handle both twenty-foot and forty-foot containers. Typical of such extensible spreader frames are those shown in the aforementioned U.S. Pat. No. R. 27,905; Zweifel et al U.S. pat. No. 3,514,146; Gottlieb et al U.S. Pat. No. 3,863,970; and Allegri U.S. Pat. No. 3,750,814.

One drawback of prior extensible spreader frames is their great weight, complexity and cost. These disadvantages have come about largely because such frames have incorporated power-operated means for extending and retracting them and additional power-operated means for operating their twist-lock latching mechanisms and grappling arms, if any. Furthermore, in the case of crane-suspended frames, such frames have also carried their own power sources, as exemplified by the aforementioned U.S. Pat. Nos. 3,514,146 and 3,888,536. As a consequence, most spreader frames have been of heavy, cumbersome, open rectangular frame construction typified by all of the aforementioned patents, and also by U.S. Pat. Nos. 3,863,970 and 3,712,661.

One exception to the typical rectangular open frame construction of spreader frames is the spreader frame shown in U.S. Pat. No. 3,750,814. Such frame is of generally telescoping single-beam construction with cross beams at the outer ends of the extensible telescoping beams. However, such frame is designed only for use by a forklift truck and, like other typical frames, employs power-operated frame extension means and power-operated container latching hooks. Accordingly, such beam-type frame is still heavy and costly to manufacture, and is suitable only for use with large, heavy duty lift trucks having an available source of hydraulic pressure fluid for the power-operated devices on the frame.

SUMMARY OF THE INVENTION

The present invention is an extensible spreader frame of basically single-beam construction as opposed to the usual open, rectangular frame construction. Its primary advantages over prior extensible spreader frames are its simple construction, light weight, and low cost, made possible in large part through the use of all-mechanical frame extension means and latching means, rather than power-operated such means.

An important safety feature of the invention is an all-mechanical locking device which prevents latching or unlatching either one of the latching hooks at one end of the frame until both such hooks are properly positioned with respect to the container.

A primary object of the invention is to provide an extensible spreader frame having a simplified single beam construction;

Another primary object is to provide a spreader frame as aforesaid which is light-weight;

Another primary object is to provide a spreader frame as aforesaid, the movable parts of which are all mechanically or manually operated to eliminate the need for mounting heavy power components on the frame, thereby facilitating the frame's simple, light-weight construction;

Another primary object is to provide a spreader frame as aforesaid which is inexpensive to produce and maintain;

Another primary object is to provide a spreader frame as aforesaid which is simple to operate;

Another primary object is to provide a spreader frame as aforesaid, the basic configuration and several features of which are adaptable for use by both overhead cranes and lift trucks.

The foregoing and other objects, features and advantages of the invention will become apparent from the following detailed description, which proceeds with reference to the accompanying drawings.

BRIEF DESCRIPTION OF DRAWINGS

In the drawings:

FIG. 6 is a fragmentary perspective view of one end portion of the spreader frame of FIG. 1 on an enlarged scale and showing a portion of its latch actuating mechanism;

FIG. 7 is a side elevational view of the mechanism of FIG. 6 on an enlarged scale and with some portions foreshortened;

FIG. 8 is a plan view of the portion of the frame shown in FIG. 6, but with parts sectioned and removed for clarity.

FIG. 11 is a plan view on an enlarged scale of the right-hand twist-lock actuating mechanism shown in FIG. 9 with some portions broken away and other portions shown in phantom to illustrate operation of the mechanism;

FIG. 12 is an elevational view of the mechanism of FIG. 11 as viewed from line 12—12 of FIG. 11;

FIG. 13 is a vertical sectional view taken along line 13—13 of FIG. 12; and FIG. 14 is a bottom view of the latching hook portion of the mechanism of FIG. 13 as viewed from line 14—14 of FIG. 13.

DETAILED DESCRIPTION OF PREFERRED EMBODIMENT

General Assembly

Figures 1, 2, 3:
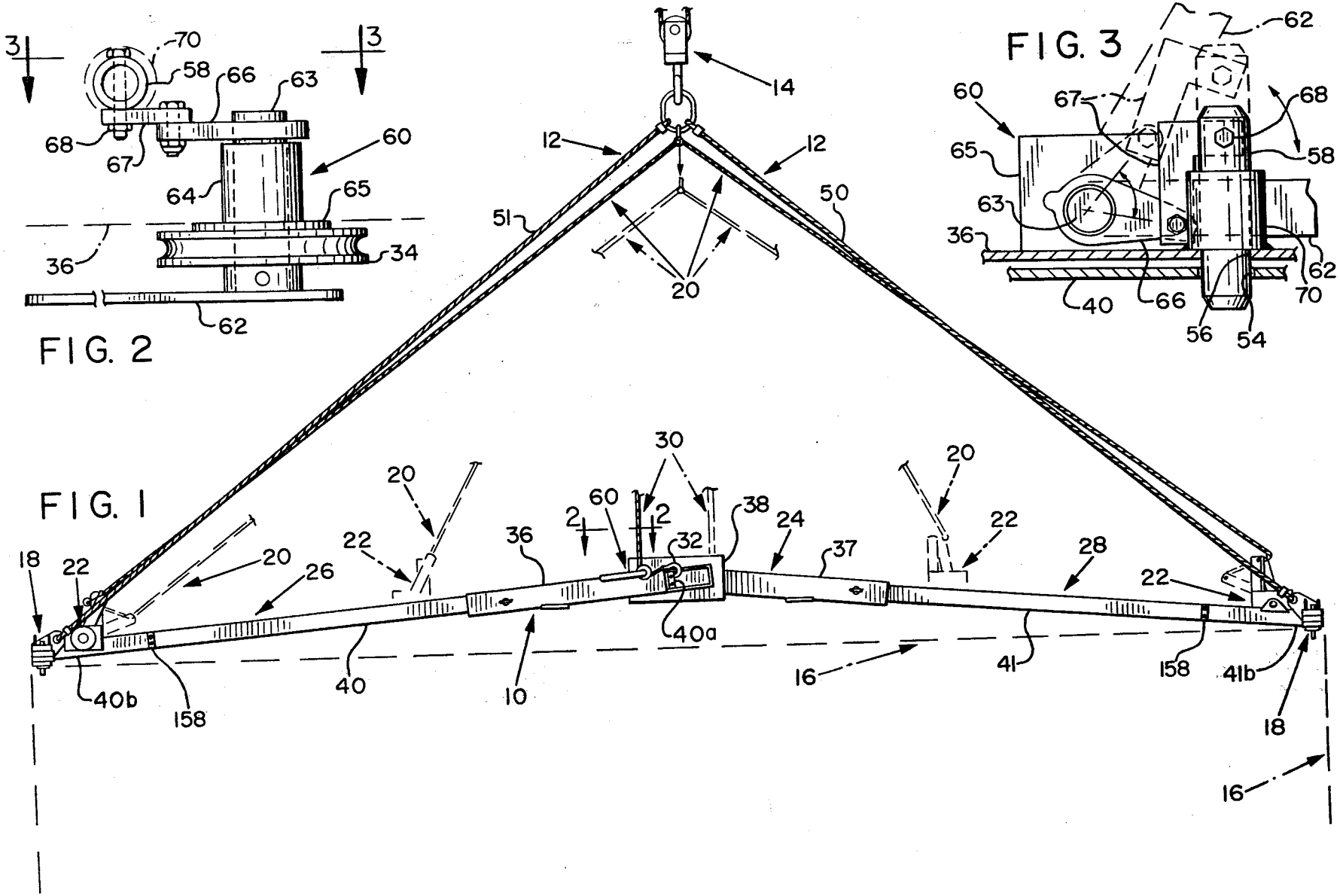
FIG. 1 is a side elevational view of a crane-suspended extensible spreader for handling cargo containers in accordance with the invention.
FIG. 2 is an enlarged plan view of a length-adjusting mechanism portion of the frame of FIG. 1 as viewed from the line 2—2 of FIG. 1.
FIG. 3 is an elevational view of the mechanism shown in FIG. 2 as viewed from line 3—3 of FIG. 2.

With reference to the drawings, in FIG. 1 a spreader frame 10 in accordance with the invention is suspended by flexible cable suspension means 12 from a load-carrying hook assembly portion 14 of an overhead crane. Spreader frame 10 is designed to top lift a container shown in phantom lines at 16 by container-engagement means indicated generally at 18 which are commonly used in the industry and known as twist-lock latching means. Such means comprise rotatable latching hooks which fit into sockets at the four top corners of a container.

The spreader frame assembly also includes a flexible latch actuating cable means 20, connected to crane hook assembly 14, and at its lower ends to a mechanical linkage on the frame. Suck linkage comprises a latch actuating means indicated generally at 22 for remote connection and disconnection of the twist-lock latching means with the container.

The spreader frame is of the extensible type. It includes a central frame housing portion 24 and extensible frame members 26, 28, slidably mounted within and through the central housing portion and extending in opposite directions therefrom.

Figure 5:
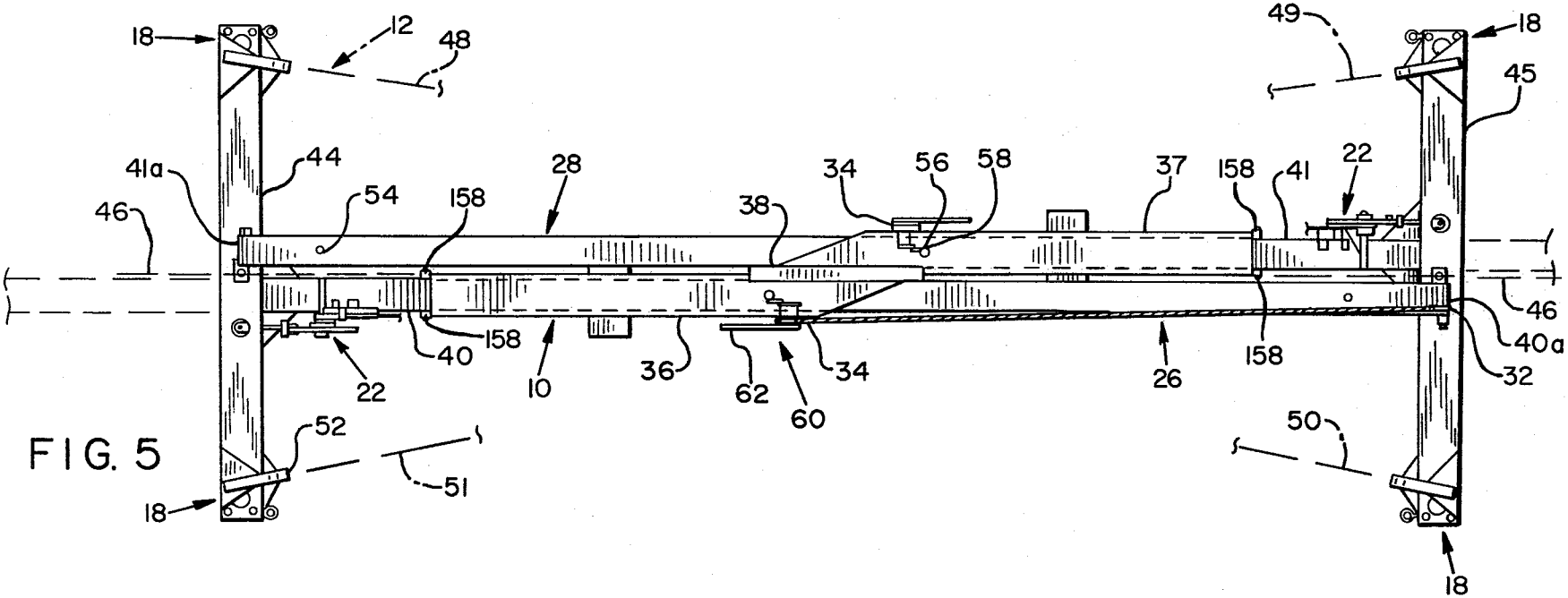
FIG. 5 is a plan view of the spreader frame of FIG. 4.
Figure 4:
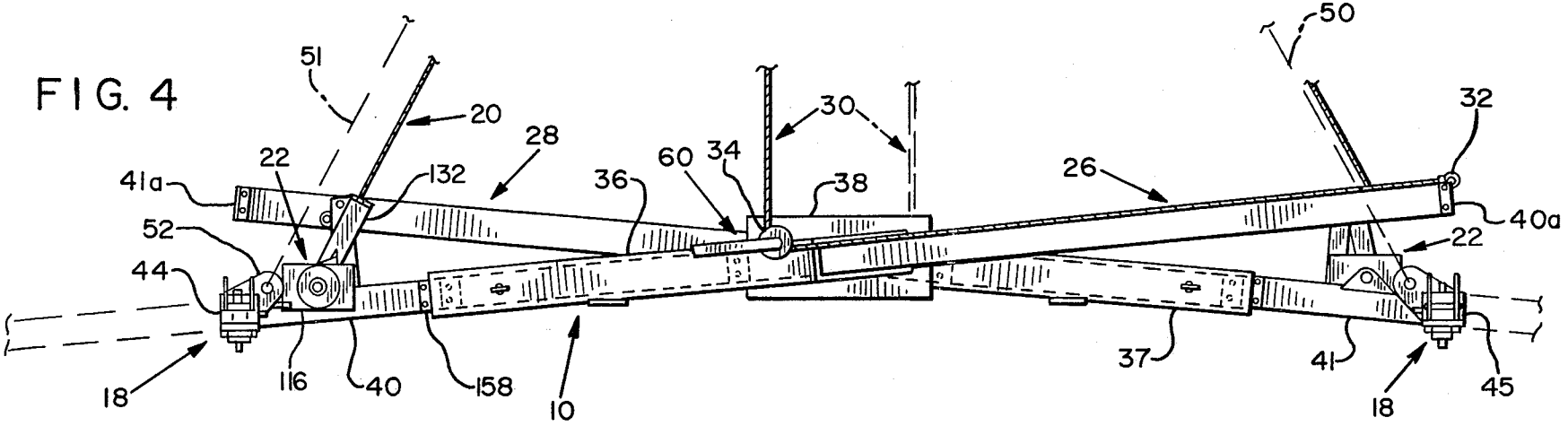
FIG. 4 is a view similar to that of FIG. 1, but showing the spreader frame in its retracted position.

Mechanical length adjustment means are provided for the frame. Such means include an all-mechanical extension means for extending the extensible frame members. Such extension means includes a flexible pull cable means 30 adapted for connection at one end (not shown) to the overhead crane and at the opposite end by releasable connector means 32 to the inner ends of the extensible frame members 26, 28. Pulley means, one pulley 34 of which is shown in FIGS. 1 and 4, and both of which are shown in FIG. 5, are provided on the central housing 24. When pull cable 30 is trained beneath a pulley 34 and connector 32 attached to the inner end of one extensible frame member 26 as shown in FIG. 4, the extensible frame member can be extended from its retracted position with an upward pull on the opposite end of the cable, using the crane. Thereafter, the pull cable can be disconnected from the one extensible frame member and attached to the inner end of the other, and the process repeated to extend the other extensible frame member.

The length of adjustment means for the spreader frame also includes locking pins, which extend through aligned pin holes in the central frame housing and extensible frame members to lock the frame members in their extended or retracted positions. A manually operated mechanical pin insertion means 60 is provided on the central housing for inserting and removing the locking pins.

Spreader Frame Assembly

The spreader frame is of a unique single-beam type construction as opposed to the more usual open, rectangular construction of most prior spreader frames. In this regard, the central frame housing 24, also known as the sleeve beam assembly, comprises a pair of oppositely downwardly extending sleeve beams 36, 37 of box frame section and open at both ends. Sleeve beams 36, 37 are joined centrally of the frame in side-by-side but longitudinally offset relationship at their respective inner ends by a connecting plate 38.

The extensible frame members 26, 28 comprise a pair of beam arms 40, 41, also of box section, which extend into and through sleeve beams 36, 37 such that the sleeve beams slidably receive and support the beam arms. In the retracted positions of the beam arms, as shown in FIG. 4, their inner ends 40*a*, 41*a* extend well beyond the corresponding inner ends of their associated sleeve beams. In the extended positions of the beam arms, their inner ends are adjacent to the inner ends of the sleeve beams while their outer ends 40*b*, 41*b* extend outwardly well beyond the corresponding outer ends of their associated sleeve beams. Stops 158 near the outer ends and at the inner ends of the beam arms determine their retracted and extended positions, respectively, as shown in FIGS. 4 and 6.

As shown best in FIG. 5, the outer ends of beam arms 40, 41 mount beam cross arms 44, 45, respectively, such cross arms also being of box section. Because of the unique configuration of the spreader frame in which each sleeve beam and associated beam arm is laterally offset from the other sleeve beam and beam arm, each beam cross arm must be mounted off-center, i.e., offset from its midpoint, with respect to its connected beam arm so that the cross arms are mounted symmetrically with respect to a longitudinal center plane 46 of the frame, shown in FIG. 5. All frame members are thus symmetrically arranged about longitudinal center plane 46 and also about a transverse center plane. Therefore, although a single beam construction is used rather than an open rectangular frame construction as in prior spreader frames, the opposite ends of the cross arms are positioned so that they still define the four corners of an imaginary rectangle of which the cross arms define the opposite ends. This feature enables the beam-type frame to align itself with the four socketed corners of a container which define a similar rectangle.

As will be apparent from FIG. 5, the flexible suspension means 12, shown in phantom lines, comprises four suspension cables 48, 49, 50, 51, connected to the spreader frame at its four corners as thus defined; that is, to ears 52 at the opposite ends of the two cross arms. The twist-lock latching devices 18 for top lifting a container are also mounted at the four corners of the imaginary rectangle defined by the cross arms; that is, at the outer ends of the cross arms.

From FIG. 1 it will be apparent that with the containerized load 16 connected to the opposite ends of the cross arms by twist-lock latches 18 and suspended by the suspension cables at the opposite ends of the cross arms, the latches, cross arms and suspension cables bear most of the load of the container. Beam arms 40, 41 serve primarily as spacers and positioners for the cross arms. However, it will be noted that the downwardly angled sleeve beams 36, 37 cause the frame assembly to assume an "upwardly arched" or "prestressed" configuration at its center to resist the tendency of the suspension cables under tension to buckle the relatively light-duty longitudinal frame members. Such "arched" configuration also facilitates retraction of the beam arms 40, 41 into their respective sleeve beams through tensioning of the suspension cables with the locking pins removed from engagement with such arms.

Arm Adjustment Means

Another unique feature of the spreader frame of the invention is its mechanical means for effecting length adjustment, including extension, retraction and retention of beam arms 40, 41, without the use or assistance of any power-operated devices other than the lifting action of the crane itself. The details of such mechanical adjustment means is best understood with reference to FIGS. 2, 3, 4 and 5 of the drawings.

The spreader arm length adjustment means includes a pair of pin holes 54 through the top wall of each beam arm 40, 41, one of which is shown at 54 of a beam arm in FIGS. 3 and 5. The pair of pin holes determine the extended and retracted positions of the beam arms for handling 20- and 40-foot containers. The spreader frame could also be adapted for handling other sizes of containers between the 20- and 40-foot lengths simply by provision of additional pin holes in the beam arms. Each sleeve beam 36, 37 is provided with a single pin hole 56 through its top wall for alignment with a selected one of the two pin holes 54 in its associated beam arm. A locking pin 58 is insertable into the aligned pin holes of a sleeve beam and beam arm assembly to lock the assembly at a selected length. Locking pin 58 is best shown in FIGS. 2 and 3, with reference to sleeve beam 36 and beam arm 40. Stop bars 158 at opposite sides of each beam arm at its inner and near its outer ends positively determine the extended and retracted positions of the arm to facilitate alignment of pin holes 56, 58.

Manually operated pin insertion and removal means are provided as indicated generally at 60. Such means includes a manual operating level 62 affixed to a shaft 63 journaled within a collar 64 on a mounting plate 65 affixed to sleeve beam 36. The opposite end of shaft 63 carries a straight lever 66 pivoted to the lower end of an angle link 67, the opposite end of which is pivoted to the upper end of locking pin 58 at pivot connection 68. Locking pin 58 is slidably mounted within a guide sleeve 70 affixed to the upper surface of sleeve beam 36 in alignment with pin hole 56.

When operating lever 62 is in its lowered near-horizontal position, shown in FIG. 3, locking pin 58 is inserted within aligned pin holes 54, 56 through the sleeve beam and beam arm to lock the two beam components together. However, when arm 62 is raised to a near vertical position, shown in phantom lines in FIG. 3, the pivoting of connected shaft 63 causes link 67 to lift locking pin 58 out of pin hole 54 of beam arm 40. Both beam sleeves 36 and 37 are provided with locking pin insertion means as just described with respect to beam sleeve 36.

The described frame length adjustment means also includes a mechanically operated frame extension means which has already been briefly described. Such means includes the previously mentioned pulley wheel 34. Such wheel is mounted on shaft 63 on the operating lever side of mounting plate 65, as shown in FIG. 2. The previously mentioned pull cable 30 includes connector means 32 in the form of a hook at one end and means (not shown) for connecting the pull cable to the overhead crane. By connecting one end of the pull cable 30 to the crane, training the cable about the underside of pulley 34, and hooking the opposite end of the cable to the inner end of one of the beam arms, such as beam arm 40 in FIG. 4, an upward pull on cable 30 with the locking pin removed from the beam arm extends the arm until its inner end stop 158 contacts the inner end of sleeve beam 36. When this occurs, the pin hole 54 closest to the inner end of the arm is aligned with the locking pin 58 and master pin hole 56 on the associated sleeve beam 36. After this procedure is used to extend beam arm 40, the same procedure is followed to extend beam arm 41. The same cable 30 is used for each arm, but a second pulley 34 is used as provided on the pin insertion means of sleeve beam 37, as shown in FIG. 5.

After the beam arms are extended and their respective locking pins inserted to hold the beam arms in their extended positions, cable 30 can be disconnected from the frame and crane. In fact, if desired, a separate cable 30 need not be provided, and instead, one of the latch actuating cables 20 could be used as the pull cable for this purpose.

Latching Mechanism

As previously mentioned, the container engagement means for the spreader frame includes four twist-lock latching hook devices 18 rotatable between latched and unlatched positions within sockets provided at the top four corners of a container. One such latching device is provided at each of the opposite ends of each beam cross arm 44, 45. EAch latching device is identical to the others, and therefore only one need be described, with reference to FIGS. 11–13. Each latching device is built into an end of one of the beam cross arms such as cross arm 44 shown in FIGS. 12 and 13.

At an outer end of the cross arm a block 72 forms the bottom wall of the box frame which defines the cross arm. The box frame at this point also defines a housing for the twist-lock hook means including a hook portion 74 and a vertical shaft portion 76. Shaft portion 76 is threaded into a hollow outer shaft portion 78 to the upper and lower portions of which a pair of vertically spaced flange members 80, 81 are mounted to define a yoke 83. The yoke mounts a pivot pin 82 and the pin in turn receives a collar 84 which forms the outer end of a mounting pin portion of a pivot arm 86. Bearings 88, 90 and 92 carried by the housing mount the pivot shaft assembly just described, including shaft 78, for rotation about a vertical axis within the housing. As shown in FIG. 11, pivoting movement of pivot arm 86 through a small angle rotates the shaft 78 and thus latching hook 74 through a 90° arc about the shaft axis as indicated by arrow 94. Stationary guide members 73 just above hook 74 and anchored to a plate 75 supported by block 72, have an outer configuration and size corresponding to those of hook 74, and prevent misalignment of the hook within its socket when the hook is in its latched position.

A unique feature of the latching mechanism described is an associated positive mechanical locking means which prevents rotation of the latching hook 74 between its "latched" and "unlatched" positions unless the latching hook is fully and properly seated within the corresponding socket of the container to be lifted. This occurs only when the cross arm is resting on top of the container. Thus, the locking means is a safety feature which prevents the latching hook from being rotated to its latching position until the hook is properly seated within the container socket, and which also prevents the hook from being rotated to its unlatched position while the cross arm is still supporting the container in suspension.

Such locking feature includes a container top sensing means in the form of a touch pad 96 shown in FIG. 12. Touch pad 96 is affixed to the lower ends of a pair of sliding pins 98, vertically slidable within lower block 72 and an upper block 99. Touch pad 96 is limited in its upper travel by the bottom surface of block 72 and in its downward travel by lower flange collar 81. The portions of sliding pins 98 between the two flange collars 80, 81 carry a locking plate 100. As shown in FIG. 11, the inner edge of locking plate 100 defines a central keyway 102, which is vertically aligned with a key 104 on shaft 78 when latching hook 74 is in its unlatched position shown. Shaft 78 also carries a second key 106. Such key is spaced horizontally through an angular distance of 90° from the first key 104 so that when the latching hook is rotated to its latching position, key 106 is aligned with keyway 102.

When touch pad 96 is in a raised or "unlocked" position shown in FIG. 12, which is the position it occupies when the associated cross arm is engaging the top of a container, locking plate 100 is positioned above and clear of keys 104, 106, thereby enabling shaft 78 and thus latching hook 74 to rotate freely between the latched and unlatched positions of the hook. However, when the end of the cross arm is spaced above the container top, such as when the spreader frame is lifting a container or is being lowered toward a container for attachment thereto, touch pad 96 drops to its lowered or "locked" position 96*a*, shown in FIG. 12. In such position, locking plate 100 drops to the level of keys 104 and 106, to interengage the aligned key, thereby preventing rotation of the latching hook between its latched and unlatched positions.

For example, when the latching hook 74 is in its unlatched position shown in FIGS. 11–13 and is being lowered toward the top of a container, touch pad 96 is in its lowered position 96*a*. Therefore, keyway 102 of locking plate 100 is interengaged with key 104 of pivot shaft 78, to prevent premature rotation of the latching hook to its latched position before the hook is fully seated within the appropriate socket of the container top. Proper seating does not occur until touch pad 96 has engaged the container top so as to be pushed to its raised position in which locking plate 100 clears key 104. Only when this occurs can latching hook 74 be rotated to its latched position.

With hook 74 in its latched position, key 106 on shaft 78 is aligned with keyway 102 of locking plate 100. Thus, when the beam cross arm carrying the latching mechanism is lifted by the crane, the cross arm is lifted from engagement with the top of the container, whereby touch pad 96 drops to its lowered position 96*a*, lowering locking plate 100 and causing keyway 102 to interengage key 106 to prevent inadvertent rotation of the latching hook from its latched position so long as the container is in suspension. Only after the container is ground-supported and the spreader frame cross arm is again lowered into engagement with the container top to raise touch pad 96, can latching hook 74 be rotated from its latched to its unlatched position.

Figure 9:
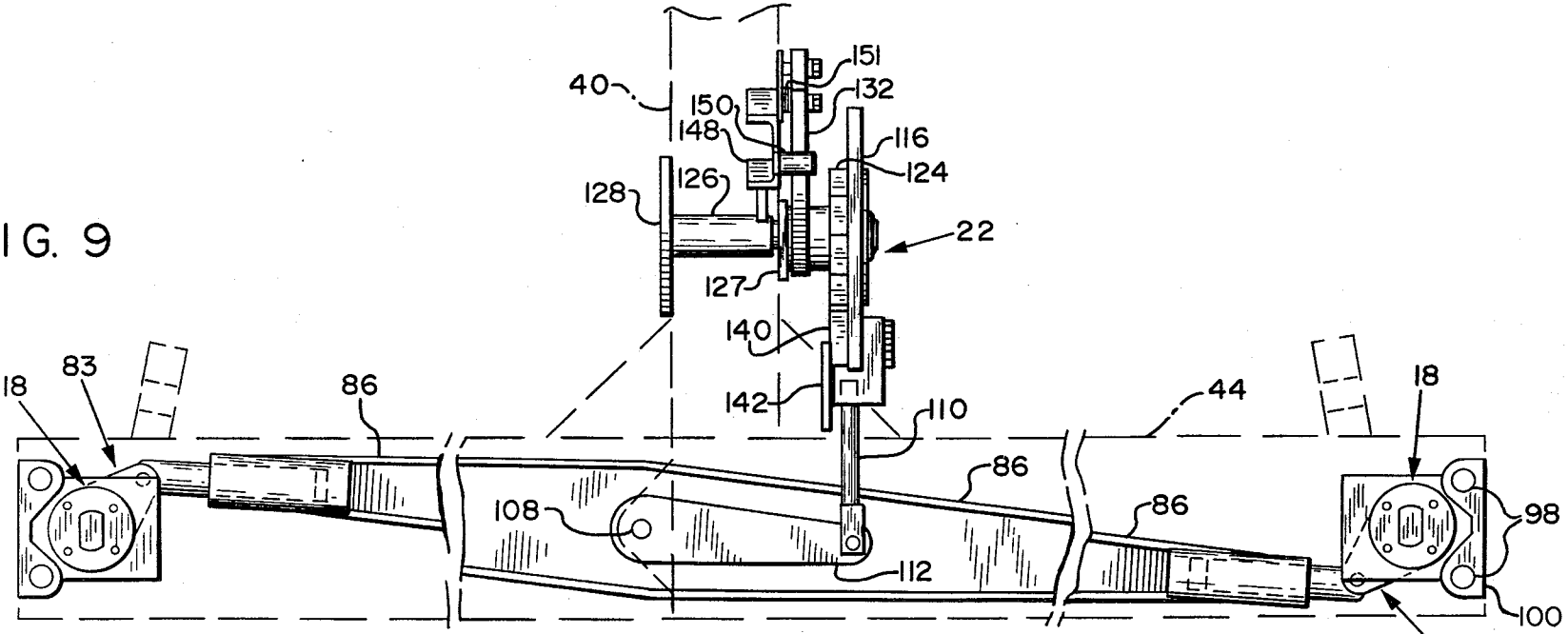
FIGS. 9 and 10 are plan and end elevational views, respectively, of one end portion of the spreader frame in FIG. 1 with outer frame portions shown in phantom and portions foreshortened to show a complete latch actuating mechanism at one end of the frame.

The foregoing positive locking feature is especially valuable because neither of the two latching mechanisms at the opposite ends of a beam cross arm can be latched or unlatched until both ends of the cross arm and both latching mechanisms are properly positioned with respect to the corresponding two sockets of a container top. The reason for this will be evident from FIGS. 9 and 10. The latching mechanism 18 at opposite ends of the cross arm 44 are both actuated by the same pivot arm 86. Pivot arm 86 is housed within the beam cross arm 44 and is mounted for pivoting movement about the vertical axis of a central pivot shaft 108. A mechanically operated latch actuating means 22, previously mentioned, pivots the pivot arm 86 through a small arc about the axis of shaft 108. The yokes 83 which connect the opposite ends of pivot arm 86 to the opposed latching mechanisms 18 of a single cross arm extend in opposite directions as shown in FIG. 9 so that when the pivot arm 86 pivots in one direction the latching hooks 74 of both latching mechanisms will be moved to corresponding latched or unlatched positions simultaneously.

From the foregoing description of pivot arm 86 and its operation, it will be apparent that pivot arm 86 is prevented from pivoting and thus moving the latching hooks between their latched and unlatched positions unless the keyways on the locking plates of both latching mechanisms are clear of their respective keys. For this condition to occur, both latching hooks 74 must be fully seated in their respective container sockets so as to cause both touch pads 96 to be in their raised positions. With either latching hook 74 out of its fully seated position within its associated container socket, neither latching hook can be rotated to its latched or unlatched position, thereby preventing premature lifting or disconnection of a container.

Latch Actuating Mechanism

A portion of the latch actuating mechanism comprising the pivot arm 86 and its pivot shaft 108 has already been described. The portion of such mechanism for pivoting pivot arm 86 will now be described in detail, especially with reference to FIGS. 6, 7 and 8, but also with reference to FIGS. 9 and 10.

Figure 10:
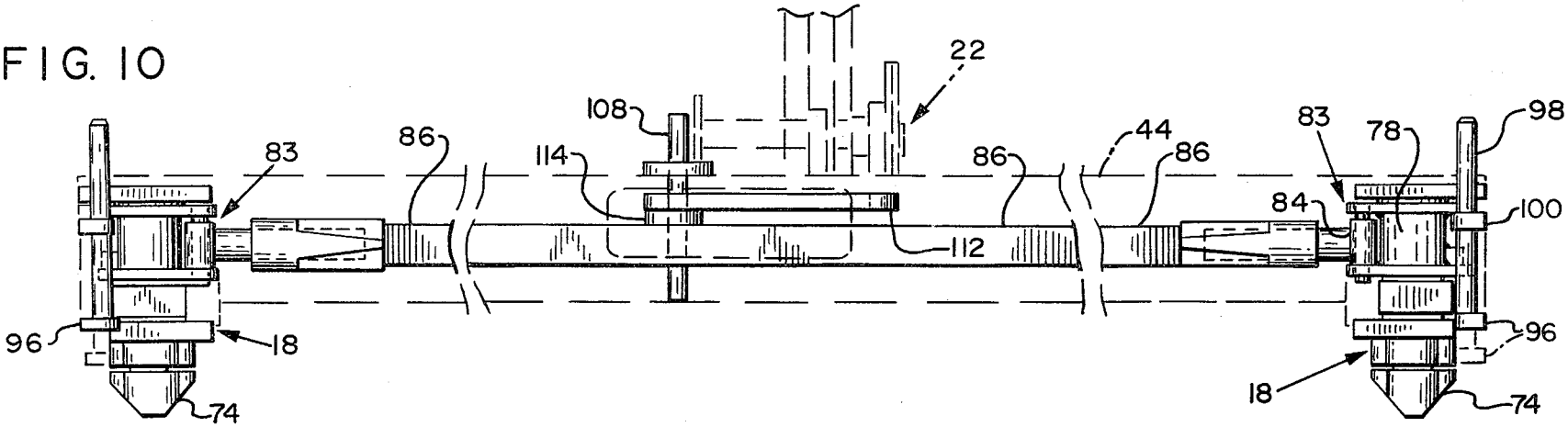

A unique feature of the latch actuating mechanism is its all-mechanical construction and operation. The actuating mechanism includes a cam-operated means including a push rod 110 pivoted at one end to a lever arm 112 as shown in FIGS. 9 and 10. The lever arm in turn is journaled on pivot shaft 108 and fixed by a collar 114 to pivot arm 86 so that reciprocation of push rod 110 oscillates lever arm 112 and pivot arm 86.

Referring now to the details of FIGS. 6, 7 and 8, push rod 110 is adjustably connected to a cam plate 116 having a central cutout defining an interior contoured cam surface 118. Three cam follower rollers 120, 121 and 122 carried by the inside face of a ratchet wheel 124 engage the cam surface 118 of the cam plate and thus support the plate on the ratchet wheel. Ratchet wheel 124 is rotatably mounted on a fixed shaft 126 mounted in brackets 127, 128 extending upwardly from opposite sides of the beam arm 40. Ratchet wheel 124 is connected by a collar 130 to a lever actuating arm 132 which is also rotatably mounted on shaft 126 so that the ratchet wheel oscillates on the shaft with the arm. A dog 134 is pivoted to arm 132 and urged by a spring 136 into engagement with a tooth 138 of ratchet wheel 124. A second dog 140 is pivoted to an upstanding plate 142 affixed to a gusset 144 between beam arm 40 and cross arm 44. This second dog is biased by a spring 145 upwardly into engagement with another tooth 146 of ratchet wheel 124. To prevent dirt from entering the camming mechanism described, the central opening in the cam plate is covered with a cover plate 154 which is held in place along with the other elements on shaft 126 by keeper collar 156.

An upright support post 148 extends upwardly from beam arm 40 adjacent to lever arm 132 and mounts an eye 149 along its upper forward edge and a fixed guide pin 150 above and rearwardly of the eye. The upper forward corner of actuating lever 132 carries a small pulley wheel 151. A flexible actuating cable 20, to which reference has been made previously, is trained beneath pulley wheel 151 and over guide pin 150, and its lower end is connected by an attached clevis 152 to eye 149.

When an upward pull is applied to cable 20, via the overhead crane, arm 132 is raised from a near-horizontal position 132*a* as shown in FIG. 7 through an arc of approximately 60° to a more upright position as shown in full lines in FIG. 7, causing dog 134, through engagement with tooth 138 of the ratchet wheel, to rotate the ratchet wheel 124 through a small (60°) arc. This, in turn, causes the cam follower rollers 120, 121 and 122 to travel through 60° about the interior camming surface 118 of cam plate 116. The camming surface 118 is contoured such that a single upward pivoting movement of lever arm 132 causes one of the three rollers 120–122 to engage one of the two horizontally opposed raised camming surface portions 118*a*, 118*b*, forcing cam plate 116 either forwardly or rearwardly to actuate push rod 110 and thus pivot arm 86. In FIG. 7 cam follower 122 engages cam surface portion 118*a* to move cam plate 116 and push rod 110 in a rearward direction. This rearward movement of push rod 110 pivots lever arm 112 in a counterclockwise direction as viewed in FIG. 8, thereby pivoting pivot arm 86 and shifting the latching hooks to either their latched or unlatched positions, as the case may be.

Following the lifting of lever arm 132 via cable 20, the cable is slacked, causing lever arm 132 to return by gravity to its lower position 132*a*. Upon return of the lever arm to its lower position, the second dog 140 maintains ratchet wheel 124 in its last determined position despite the disengagement of dog 134 from the ratchet wheel. The next successive tensioning of cable 20 and thus upward movement of actuating lever 132 causes dog 134 to engage the next successive ratchet tooth to again rotate the ratchet wheel through a 60° arc. Upon such rotation, cam follower 120 engages the raised portion 118*b* of camming surface 118 to induce forward movement of cam plate 116 and connected push rod 110 to pivot lever arm 112 in a clockwise direction as viewed in FIG. 8. This in turn pivots the pivot arm 86 in the opposite direction to rotate latching hooks 74 to either a latched position if previously unlatched, or to an unlatched position if previously latched.

From the foregoing, it will be apparent that each upward movement of actuating arm 132 as induced by actuating cable 20 causes successively alternating forward and rearward movements of cam plate 116 and its connected push rod 110. Consequently, if the latching hooks are in their latched positions, an upward movement of the actuating lever will unlatch the hooks. Conversely, if the latching hooks are in their unlatched positions, the next upward movement of arm 132 will shift the hooks to their unlatched positions. Accordingly, the latching hooks at both ends of a beam cross arm can be shifted between their latched and unlatched positions remotely by alternately tensioning and slacking the actuating cable 20 from the overhead crane.

Operation

It is believed that operation of the spreader frame and its various components will be apparent from the foregoing description.

Summarizing, with the spreader frame ground-supported, first the beam arms are adjusted to lengths such that the overall length of the frame corresponds to the lengths of the containers to be handled. This is accomplished by removing the locking pin from one beam arm using the associated pin insertion means 60, then either extending or retracting the arm as required. If retracting, this can be accomplished with both arms simultaneously simply by tensioning the suspension cables 48–51 with the locking pins of both arms removed. If extending, the pull cable 30 is applied to one pulley 34 and its associated arm at a time. When the arms 40, 41 are adjusted for length, their locking pins ae reinserted, using pin insertion means 60 once more.

Next, with the twist-lock hooks in their unlatched positions, the spreader frame is raised by the overhead crane, positioned over a container, and lowered onto a container so that the twist-lock hooks enter the container corner sockets. Lowering continues until the frame cross arms rest on the container top, raising the touch pads 96 to their "unlocked" positions. When this occurs, actuating cables 20 for both ends of the frame are tensioned, raising actuating levers 132 of the twist-lock actuating means 22 at both ends of the frame. As a result, pivot arms 86 within both cross arms 44, 45 rotate the twist-lock hooks 74 to their "latched" positions. Thereafter, the container can be top-lifted and carried by the crane to a loading or unloading point.

To unlatch the container from the spreader frame, the procedure is reversed. The spreader frame is lowered until the attached container is supported from below and the suspension cables slacked so that the frame cross arms 44, 45 rest on the container top. This elevates touch pads 96 to enable rotation of the twist-lock hooks 74 to their "unlatched" positions by tensioning actuating cables 20 to lift actuating arms 132.

Thereafter, the frame is lifted from the container by the crane to complete a container handling cycle.

The spreader frame described can also be adapted for use on a lift truck. However, for lift truck applications in which a source of hydraulic pressure fluid is available on the truck, power cylinders can be used to extend and retract the beam arms and to operate the push rods 110 which actuate the pivot arms 86 to operate the twist-lock hooks. Thus, in lift truck applications the mechanical arm extension and adjustment means can be eliminated as can be the mechanical latch actuating means.

In lift truck applications the spreader frame would also be suspended via flexible suspension cables or chains from a short overhead frame carried by the lift truck's vertically extensible front mast or carriage structure. Thus, the spreader frame would normally be suspended by its sleeve beams rather than by its cross arms. For this reason, the spreader frame configuration need not be "arched" in lift truck applications. Because the beam arms of the spreader frame must support substantial loads and would be subjected to high bending stresses in lift truck applications, the beam arms of such spreader frames must be designed accordingly.

Having illustrated and described the principles and features of the invention by what is presently a preferred embodiment, it should be apparent to persons skilled in the art that such embodiment may be modified in arrangement and detail without departing from such principles and features. Claimed as part of the invention are all such modifications within the true spirit and scope of the following claims:

I claim:

1. An extensible lifting spreader frame for handling cargo containers, comprising:

a central pair of sleeve beams joined together side-by-side, each being open at both ends, a pair of beam arms, one slidably mounted through each sleeve beam for extension and retraction, each said beam arm being extensible in an opposite direction from the other, and container engagement means at the outer end of each beam arm for engaging said spreader frame with a cargo container to enable lifting said container by lifting said frame, a beam cross arm mounted to the outer end of each beam arm, said container engagement means including engagement means at the opposite ends of each said cross arm, each engagement means comprising twist-lock latching means for engagement with socket means at the four top corners of a cargo container for top-lifting a container, mechanically and remotely operated latch actuating means operable to simultaneously operate said latching means at the opposite ends of one said beam cross arm, said latch actuating means including a pivot arm pivotally mounted within each said cross arm, said pivot arm being operably connected at its opposite ends to said latching means at opposite ends of said cross arm for rotating said latching means between latched and unlatched positions upon pivoting movement of said pivot arm, cam-operated means on an associated said beam arm for pivoting said pivot arm, lever-operated means including a cam for operating said cam-operated means, and flexible cable means operably connected to a lever for actuating said lever-operated means to latch and unlatch said latching means.

2. An extensible lifting spreader frame for handling cargo containers, comprising:

a central pair of sleeve beams rigidly joined together side-by-side, each being open at both ends, a pair of beam arms, one slidably mounted through each sleeve beam for extension and retraction, each said beam arm being extensible in an opposite direction from the other, and container engagement means at the outer end of each beam arm for engaging said spreader frame with a cargo container to enable lifting said container by lifting said frame, said pair of sleeve beams being angled downwardly in opposite directions from their intersection with one another so as to define a spreader frame with a center elevation above its opposite end elevations.

3. An extensible lifting spreader frame for handling cargo containers, comprising:

a central pair of sleeve beams joined together side-by-side, each being open at both ends, a pair of beam arms, one slidably mounted through each sleeve beam for extension and retraction, each said beam arm being extensible in an opposite direction from the other, and container engagement means at the outer end of each beam arm for engaging said spreader frame with a cargo container to enable lifting said container by lifting said frame, frame length adjustment means for adjusting the spreader frame to selected lengths, said adjustment means comprising locking pin means for each beam arm, multiple pin hole means spaced apart along the length of said beam arms, single pin hole means in each sleeve beam for registration with a selected one of said multiple pin hole means in each beam arm, and manually operable pin insertion means on each sleeve beam mounting said pin means for insertion in and removal from aligned said pin hole means in said sleeve beam and the associated said beam arm, said adjustment means including extension means for extending said beam arms from their associated sleeve beams, said extension means comprising pulley means carried by said pin insertion means and flexible pull cable means trainable about said pulley means and having a connector means at one end thereof for releasable connection to the inner end of an associated said beam arm.

4. An extensible lifting spreader frame for handling cargo containers, comprising:

a central pair of sleeve beams joined together side-by-side, each being open at both ends, a pair of beam arms, one slidably mounted through each sleeve beam for extension and retraction, each said beam arm being extensible in an opposite direction from the other, and container engagement means at the outer end of each beam arm for engaging said spreader frame with a cargo container to enable lifting said container by lifting said frame, frame length adjustment means for adjusting the spreader frame to selected lengths, said adjustment means comprising locking pin means for each beam arm, multiple pin hole means spaced apart along the length of said beam arms, single pin hole means in each sleeve beam for registration with a selected one of said multiple pin hole means in each beam arm, and manually operable pin insertion means on each sleeve beam mounting said pin means for insertion in and removal from aligned said pin hole means in said sleeve beam and the associated said beam arm, said pin insertion means including an operating lever means connected to a rotatably mounted shaft, guide sleeve means slidably receiving said locking pin means in alignment with said single pin hole means, and articulated linkage means interconnecting said pin means and said shaft such that oscillation of said lever means to oscillate said shaft, reciprocates said pin means into and out of said single pin hole means.

5. In an extensible lifting spreader frame for handling cargo containers in which a frame assembly defines four corners of the spreader frame, with each corner including a twist-lock latching means for engaging with socket means at the four top corners of a cargo container for top lifting the container, mechanically and remotely operated latch actuating means operable to simultaneously operate a pair of said latching means at adjacent end corners of said frame assembly, said latch actuating means comprising:

a pivot arm pivotally mounted on said assembly, said pivot arm being operably connected at its opposite ends to said pair of latching means for rotating said latching means between latched and unlatched positions upon pivoting movement of said pivot arm, cam-operated means on said assembly for pivoting said pivot arm, lever-operated means including a cam for operating said cam-operated means, and flexible cable means operably connected to a lever for actuating said lever-operated means to latch and unlatch said latching means.

6. Apparatus according to claim 5 wherein said cam includes a cam plate having an opening therethrough defining a cam surface, said cam-operated means includes linkage means interconnecting said cam plate and said pivot arm, said lever-actuated means includes cam follower means rotatable along said cam surface, a ratchet wheel mounting said cam follower means, and dog means operated by said lever for ratcheting said ratchet wheel such that oscillation of said lever affects reciprocation of said cam plate, said camming surface being contoured such that two oscillations of said lever effect one reciprocation of said cam plate and pivoting movement of said pivot arm in opposite directions.

* * * * *